US009823592B2

(12) United States Patent
Lee et al.

(10) Patent No.: US 9,823,592 B2
(45) Date of Patent: Nov. 21, 2017

(54) COATED PHOTOCONDUCTIVE SUBSTRATE

(71) Applicant: Hewlett-Packard Development Company, L.P., Colorado Springs, CO (US)

(72) Inventors: Michael H. Lee, San Jose, CA (US); Krzysztof Nauka, Palo Alto, CA (US); Sivapackia Ganapathiappan, Los Altos, CA (US); Omer Gila, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/888,362

(22) PCT Filed: Jul. 31, 2013

(86) PCT No.: PCT/US2013/052850
§ 371 (c)(1),
(2) Date: Dec. 1, 2015

(87) PCT Pub. No.: WO2015/016856
PCT Pub. Date: Feb. 5, 2015

(65) Prior Publication Data

US 2016/0116852 A1 Apr. 28, 2016

(51) Int. Cl.
*G03G 5/147* (2006.01)
*G03G 5/043* (2006.01)

(52) U.S. Cl.
CPC ..... *G03G 5/043* (2013.01); *G03G 5/147* (2013.01); *G03G 5/14752* (2013.01); *G03G 5/14769* (2013.01); *G03G 5/14791* (2013.01)

(58) Field of Classification Search
CPC ..... G03G 5/147; G03G 5/1473; G03G 15/00
See application file for complete search history.

(56) References Cited

U.S. PATENT DOCUMENTS 4,358,519 A 11/1982 Chang et al.
5,693,442 A 12/1997 Weiss et al.
6,664,361 B2 12/2003 Sasaki et al.
(Continued)

FOREIGN PATENT DOCUMENTS

CN 101661231 3/2010
CN 102150087 8/2011
(Continued)

OTHER PUBLICATIONS

Extended European Search Report dated Jun. 29, 2016 for PCT/US2013/052850; Applicant Hewlett-Packard Company, L.P. Development.

(Continued)

*Primary Examiner* — Peter Vajda
(74) *Attorney, Agent, or Firm* — Thorpe, North & Western L.L.P.

(57) ABSTRACT

The present disclosure is drawn to apparatuses and methods that include a coated photoconductive substrate. The coated photoconductive substrate can include a photoconductive substrate with a charge generation layer and a charge transport layer, and can also have a coating adhered to the photoconductive substrate. The coating can have a thickness ranging from 1 nm to 200 nm.

18 Claims, 5 Drawing Sheets

(56) References Cited

U.S. PATENT DOCUMENTS

| | | | | |
|---|---|---|---|---|
| 7,452,640 | B2 | 11/2008 | Shoshi et al. | |
| 7,700,248 | B2 | 4/2010 | Jin et al. | |
| 2003/0195283 | A1 | 10/2003 | Lee et al. | |
| 2004/0023140 | A1* | 2/2004 | Kawamura | G03G 5/08221 430/66 |
| 2004/0091801 | A1 | 5/2004 | Joo et al. | |
| 2006/0286473 | A1 | 12/2006 | Kami | |
| 2007/0042281 | A1* | 2/2007 | Orito | G03G 5/0696 430/59.5 |
| 2007/0071501 | A1* | 3/2007 | Akioka | G03G 9/125 399/237 |
| 2007/0109396 | A1 | 5/2007 | Denton et al. | |
| 2011/0086299 | A1 | 4/2011 | Silvestri et al. | |

FOREIGN PATENT DOCUMENTS

| | | |
|---|---|---|
| EP | 0589776 | 3/1994 |
| EP | 0767411 | 4/1997 |
| EP | 1319989 | 6/2003 |
| KR | 1020050035570 | 4/2005 |

OTHER PUBLICATIONS

International Search Report and Written Opinion dated Apr. 30, 2014 for International Application No. PCT/US2013/052850 filed Jul. 31, 2013, Applicant Hewlett-Packard Development Company, L.P.

* cited by examiner

COATED PHOTOCONDUCTIVE SUBSTRATE

BACKGROUND

In many printing systems, it is common practice to develop a hardcopy of an image by using a photoconductive substrate. The photoconductive substrate is charged and selectively discharged to form a latent electrostatic image having image and background areas. For example, a liquid developer including charged toner particles in a carrier liquid can be brought into contact with the surface of the selectively charged photoconductive substrate. The charged toner particles adhere to the image areas of the latent image while the background areas remain clean. A hardcopy material (e.g., paper or other print substrate) is brought directly or indirectly into contact with the photoconductive surface in order to transfer the latent image. Variations of this method utilize different ways for forming the electrostatic latent image on a photoreceptor or on a dielectric material.

BRIEF DESCRIPTION OF THE DRAWINGS

Features and advantages of the present disclosure will be apparent from the detailed description which follows, taken in conjunction with the accompanying drawings, which together illustrate, by way of example, features of the disclosure.

Figure 1:
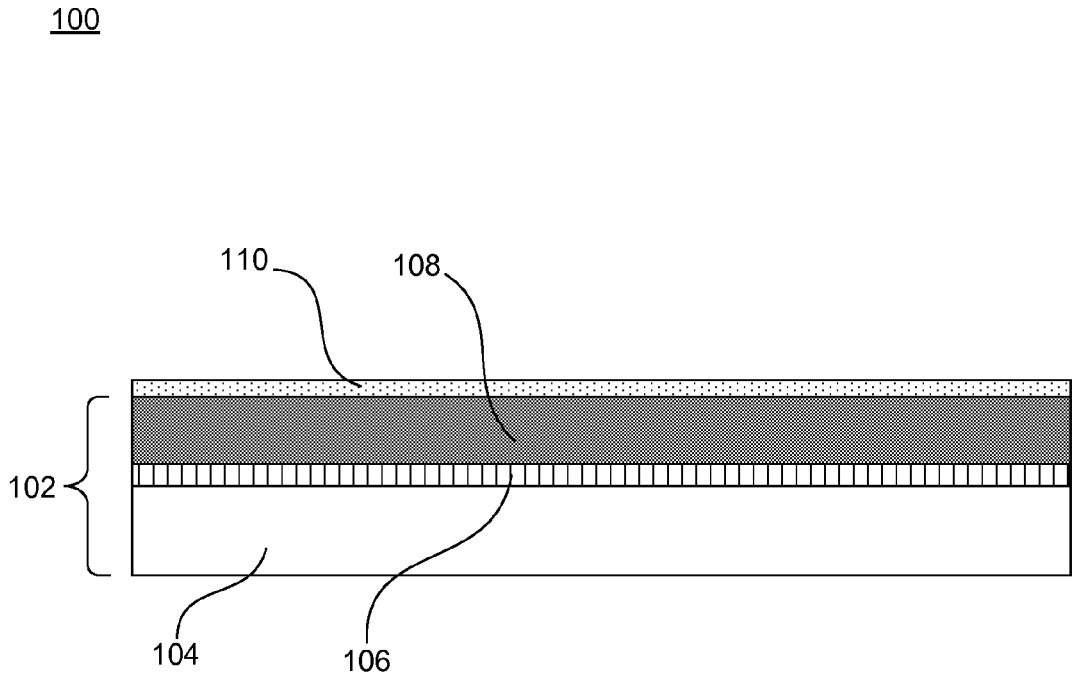
FIG. 1 is a cross-section of a coated photoconductive substrate in accordance with one example of the present disclosure.

Reference will now be made to the exemplary embodiments illustrated, and specific language will be used herein to describe the same. It will nevertheless be understood that no limitation of the scope of the disclosure is thereby intended.

DETAILED DESCRIPTION

Before the present technology is disclosed and described, it is to be understood that this disclosure is not limited to the particular process steps and materials disclosed herein because such process steps and materials may vary somewhat. It is also to be understood that the terminology used herein is used for the purpose of describing particular embodiments only. The terms are not intended to be limiting because the scope of the present disclosure is intended to be limited only by the appended claims and equivalents thereof.

It has been recognized that it would be advantageous to develop a photoconductive substrate having extended life in printing systems. Notably, typical photoconductive substrates in liquid electrophotographic printing systems often fail to maintain good print quality due to the appearance of lighter density streaks along the process direction on the print. Such non-uniformity problems are commonly referred to as OPS (old photoconductor syndrome). Various theories have been advanced as to the exact mechanism of OPS. For example, excess printing ink residues can build up on the photoconductive substrate and accumulate excess charge, causing uniform lightening of the print which can be subsequently removed locally by, for example, an embedded particle in the cleaning system, resulting in darker line down the page. Commonly, electrophotographic printing systems include a cleaning station to attempt to reduce excess residues using a scrubbing roller and a cleaning blade. Other solutions to OPS have included attempts to remove excess charges on the surface of the photoconductive substrate during printing. However, OPS remains a problem and is a source of poor print quality.

In accordance with this, the present disclosure is drawn to coated photoconductive substrates, as well as associated methods involving such coatings and liquid electrophotographic printers using such coated photoconductive substrates. Notably, it has been recognized that coating existing photoconductors in printing systems with a polymer, such as a cross-linkable polymer, at a thickness of 1 nm to 200 nm can extend the life of the photoconductor without the need for charge transport materials in the coating while preserving the functionality and performance of the latent image former. Specifically, it has been found that a coating, e.g. polymer coating, having a thickness under about 200 nm does not affect the charging and discharging properties of the photoconductive substrate, thereby allowing the exclusion of expensive charge transport materials and additives, while protecting the photoconductive substrate and extending the working life of the photoconductive substrate. For example, the present coatings can increase the working life of a photoconductor substrate by 2× (twice) that of a comparable photoconductive substrate not having the present coatings. The present coated photoconductive substrates can be used in conjunction with existing printing inks, e.g., liquid electrophotographic (LEP) inks, and LEP printers.

It is noted that when discussing a coated photoconductive substrate, a method of extending the life of a photoconductive substrate, or a LEP printer using the present coated photoconductive substrates, each of these discussions can be considered applicable to each of these embodiments, whether or not they are explicitly discussed in the context of that embodiment. Thus, for example, in discussing a coating for a coated photoconductive substrate, such a coating can also be used in a method of extending the life of a photoconductive substrate or a LEP printer, and vice versa.

As such, with the present discussion in mind, a coated photoconductive substrate can include a photoconductive substrate having a charge generation layer and a charge transport layer and a coating adhered to the photoconductive substrate. The coating generally has a thickness ranging from 1 nm to 200 nm and including a cross-linkable polymer. The coating can include a polymeric material, such as a thermoplastic polymer, an anti-oxidant polymer, and/or a cross-linkable polymer. In certain examples, the coating can consist of or consist essentially of one of these types of polymeric material. Thus, the coating can be devoid of charge transport materials in certain examples. In further detail, the photoconductive substrate can be a photo imaging plate in a liquid electrophotographic printer.

Generally, the coatings described herein do not affect the electrostatic properties of the photoconductive substrate thereby allowing printing while protecting the photoconductive substrate. The thickness of the coating generally ranges from 1 nm to 200 nm. In one example, the thickness can be from 5 nm to 150 nm, and in one aspect, from 20 nm to 80 nm. The coating generally includes a thermoplastic polymer or cross-linkable polymer or mixture of both and a cross-linker, and can be devoid of charge transport materials as discussed herein. Regarding the thermoplastic polymer, such polymer generally includes with pre-formed polymer and remains as it is after coating. Some examples are polyvinylphenols and polyvinylbutyrals. Regarding the cross-linkable polymer, such polymer generally includes moieties having cross-linkable functionality. The cross-linkable polymer is generally polymerized from monomers, also refers to as "polymerized monomers." In one example, the polymerized monomers can be selected from acrylates, methacrylates, vinyl monomers, isocyanates, polyols, epoxies, ethers, combinations thereof, and mixtures thereof. In one aspect, the cross-linkable polymer can include a polymerized monomer selected from the group of vinylphenol, vinylbutyral, styrene, hydroxyethyl acrylate or methacrylate, vinylpyridine and butylene glycol. Regarding the cross-linker, such materials consist of two or more polymerizable or reactable units. Some examples are bisphenol A dimethacrylates, bisphenol A ethoxylate dimethacrylates, pentaerythritols, pentaerythritol triacrylates, pentaerythritol trimethacryaltes, pentaerythritol tetraacrylates, pentaerythritol tetramethacrylates, bisphenol A diglycidyl ethers, butanediol diglycidyl ethers, bisphenol A ethoxylates, brominated bisphenol A diglycidyl ethers, diisocyanates such as tolylenedisiocyanate, isophoronediisocyanate or 1,8-diisocyantooctane and 1,8-octanediol, combinations thereof, and mixtures thereof. The present coating can also include an antioxidant polymer. As used herein, "antioxidant polymer" refers to polymers that inhibit the oxidation of other molecules. In one example, antioxidant polymers can include polyvinylphenols, hindered amines, and mixtures thereof. In certain examples, the thermoplastic polymer, anti-oxidant polymer, cross-linkable polymer, or mixture of these types of polymer can be present in the coating in an amount of 50 wt % to 99.9 wt %. Some examples of anti-oxidant compounds and polymers are Songnox® 11B, 21B, 311B, 321B, 417B, 1010, 1024, 1035, 1098, 1135, 1290, 1330, 2450, 2500 and 2590. Some examples of hindered amines and polymeric hindered amines are Songlight® 1190, 2920, 6220LD, 7700, 7830, 9440 and 9440SB. All of these materials are manufactured from Songwon Industrial Company, Ltd. and available from R.T. Vanderbilt Company, Inc., Norwalk, Conn. In addition, large number of anti-oxidants and hindered amines also available from BASF with Tinuvin® and Irgastab® trademarks as light stabilizers.

Additionally, when the coating is crosslinkable, coatings can include a cross-linker, which refers to a compound capable of cross-linking two polymer chains. Such a cross-linker typically reacts with functional groups on cross-linkable monomers from two discrete polymer strands. In one example, the cross-linker can be selected from the group of polyisocyanates, polyols, polyacids, polyesters, polyamines, combinations thereof, and mixtures thereof. The cross-linker can be present in the coating from 0.1 wt % to 50 wt %.

As previously discussed, the present coating is applied thin enough such that the electrostatic properties from the photoconductive substrate are not affected. Therefore, the present coatings are generally devoid of charge transport materials. Such charge transport materials can include tri-p-tolylamine (PTA), N,N'-bis(3-methylphenyl)-N,N'-diphenylbenzidine (TBD), chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene-4-on, 1,3,7-trinitrodibenzothiophene-5,5-dioxide, diphenoquinones, oxazoles, oxadiazoles, imidazoles, monoarylamines, diarylamines, triarylamines, stilbenes, α-phenyl stilbenes, benzidines, diarylmethanes, triarylmethanes, 9-styrylanthracenes, pyrazolines, divinyl benzenes, hydrazones, indenes, butadienes, pyrenes, bisstylbenes, enamines, aromatic tertiary amines, and mixtures thereof.

Generally, the present coatings can be used with any type of photoconductive substrates in printing systems, e.g., organic photoconductors. As such, the coated photoconductive substrates generally include a charge generation layer and a charge transport layer in addition to the coatings described herein. Generally, the charge generation layer can be present on the photoconductive substrate at a thickness ranging from 0.5 micron to 2 microns. Additionally, the charge transport layer can be present at a thickness ranging from 5 micron to 25 microns. The charge transport layer can include charge transport materials.

The charge generation layer can include organic charge generation materials. These organic materials may be selected from conventional materials, and examples thereof include phthalocyanine pigments such as metal phthalocyanine, non-metal phthalocyanine, azulenium salt pigments, aquatic acid methine pigment, azo pigments having a carbazole skeleton, azo pigments having a triphenylamine skeleton, azo pigments having diphenylamine skeleton, azo pigments having dibenzothiophene skeleton, azo pigments having fluorenone skeleton, azo pigments having oxadiazole skeleton, azo pigments having bisstylbene skeleton, azo pigments having distyryl oxidiazole skeleton, azo pigments having distyrylcarbazole skeleton, perylene pigments, anthraquinone or polycyclic quinone pigments, quinone imine pigments, diphenylmethane pigments, triphenylmethane pigments, benzoquinone pigments, naphthoquinone pigments, cyanine pigments, azomethine pigments, indigoido pigments, or bisbenzimidazole pigments. These charge generating materials may be used alone or in combination.

The coatings can be used with photoconductive substrates and still provide acceptable $V_{light}$. As used herein, "$V_{light}$" refers to the measured voltage between a front side and a grounded back side of the photoconductive substrate in LEP printing systems after illumination causes controlled neutralization of the electrical charges from the front side of the photoconductive substrate. In one example, the coating can provide a $V_{light}$ of less than 200 V after 100,000 printed images. In one aspect, the coating can provide a $V_{light}$ of less than 150 V after 100,000 printed images.

Referring now to FIG. 1, a coated photoconductive substrate 100 can include a photoconductive substrate 102 including a substrate 104 having a charge generation layer 106 and a charge transport layer 108 applied thereon. The photoconductive substrate can be coated with a coating 110, such as a polymeric coating described herein. Additionally, the photoconductive substrates can include a metal layer between the substrate and the charge generation layer (not shown). Generally, the coating is applied to the charge transport layer of the photoconductive substrate.

With FIG. 1 as an exemplary reference, a method of manufacturing a photoconductive substrate can include applying a coating to a photoconductive substrate, wherein the coating has a thickness ranging from 1 nm to 200 nm. Additionally, the coating can be devoid of charge transport materials. As mentioned, the coating can be a polymeric coating, and may include, consist of, or consist essentially of cross-linkable polymer, thermoplastic polymer, antioxidant polymer, or mixtures thereof.

The coating can be applied by various techniques including wired bar coating, spray coating, dip coating, doctor blade coating, etc. The cross-linkable polymer can be dissolved or suspended in a solution prior to coating. As such, in one example, the concentration of the polymer can be from 0.05 to 1.0% by weight in isopropyl alcohol or mixture of isopropyl alcohol and other isopropyl alcohol soluble organic compounds such as butyl alcohol, butyl acetate or fluoro alcohols such as hexafluoropropanol. The amount of these co-solvents can be from 0.5 to 25% by weight of isopropyl alcohol. Other additives can be added to improve the coating uniformity. For these additives, alcohols, esters, ethers and keto compounds containing carbon atoms greater than 5 can be added from 0.01 to 5% of coating materials. Once formed, this solution can be coated as discussed herein and dried to remove the organic solvents thereby providing the coating.

Turning now to the liquid electrophotographic printer described herein, this printer can include a coated photoconductive substrate for forming an electrostatic image, a charging unit configured to charge at least a portion of the photoconductive substrate forming a latent image, a binary image developer for applying electrophotographic ink to the latent image forming a developed image, an intermediate transfer member that receives the developed image, and an impression roller having a recording medium that receives the developed image from the intermediate transfer member.

Figure 2:
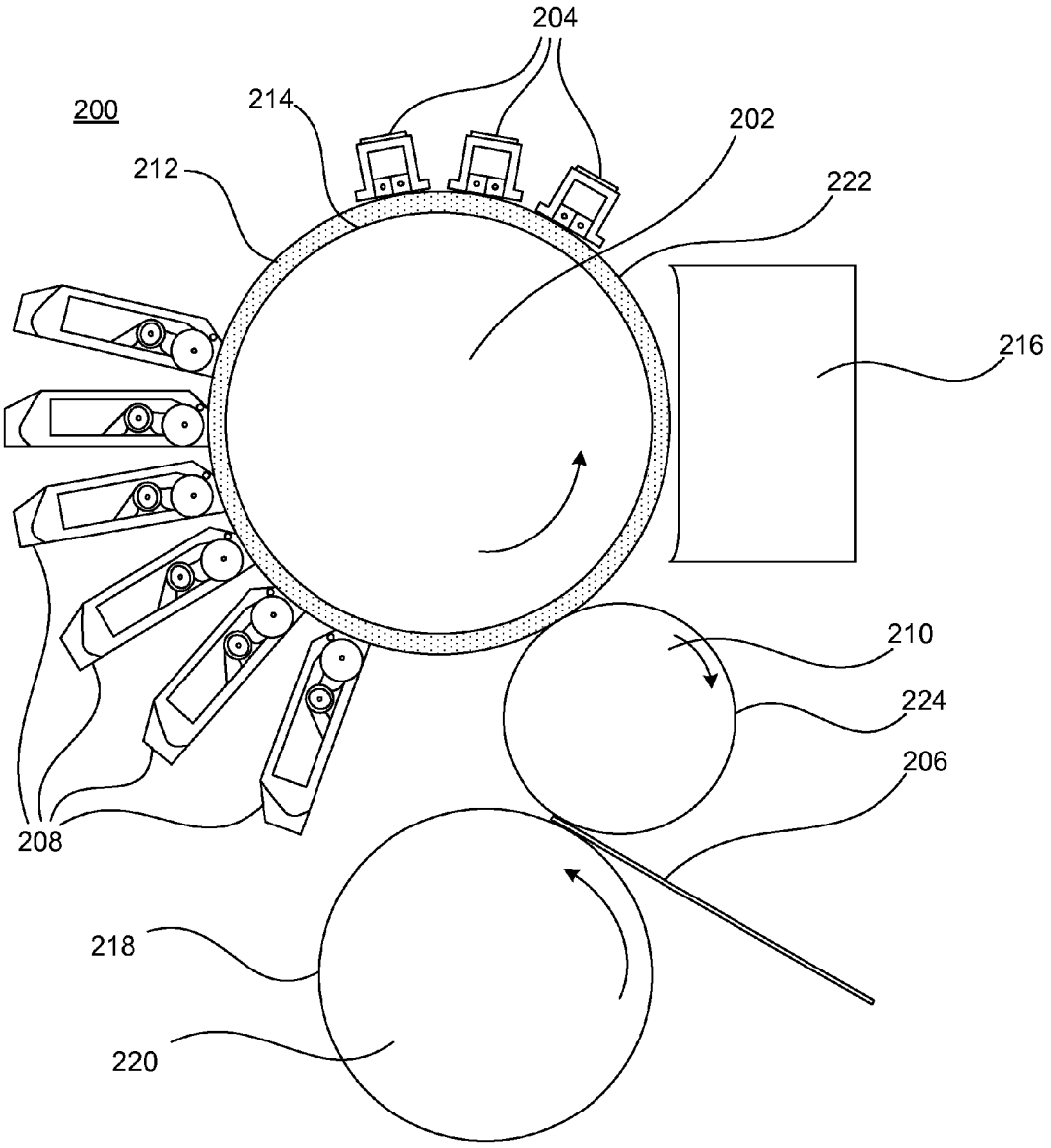
FIG. 2 is a general schematic of one possible print engine from a liquid electrophotographic printer in accordance with one example of the present disclosure.

In further detail, as shown in FIG. 2, a liquid electrophotographic (LEP) print engine 200 is shown in accordance with one example of the disclosure. It is noted that the elements of FIG. 2 are not necessarily drawn to scale, nor does it represent every photoconductive printing system available for use herein, i.e. it provides merely an exemplary embodiment of one photoconductive printing system. In this example, the LEP print engine 200 can form a latent image on a photo imaging plate (PIP) 202 by charging at least a portion of the PIP with charging units 204. The charging mechanism can include one or multiple unit charging subunit (not shown) followed by a laser discharging unit (not shown). Typically, the charging of the PIP corresponds to an image which can be printed by the LEP printing engine on a recording medium 206. The latent image can be developed by liquid toner/liquid electrophotographic ink from binary image developers (BID) 208. The liquid electrophotographic ink adheres to the appropriately charged areas of the PIP developing the latent image thereby forming a developed image. The developed image can be transferred to an intermediate transfer member (ITM) 210. Additionally, the developed image can be heated on the ITM. The developed image can then be transferred to a recording medium as described herein.

The PIP can have a coating 212 directly applied to the surface 214 of the PIP. The PIP can be optionally discharged and cleaned by a cleaning/discharging unit 216 prior to recharging of the PIP in order to start another printing cycle. As the substrate passes by the ITM, the developed image located on the ITM can then be transferred to the recording medium. Affixation of the developed image to the recording medium can be facilitated by locating the recording medium on the surface 218 of impression roller 220, which can apply pressure to the substrate by compressing it between the impression roller and the ITM as the image is being transferred to the recording medium. Eventually, the recording medium bearing the image exits the printer. In one embodiment, the printer can be a sheet-fed printer. In another embodiment, the printer can be a web-fed printer.

FIG. 2 also shows a plurality of BID units located on the PIP. In one embodiment, each BID can contain a different colored liquid electrophotographic ink, for use in producing multi-color images. Generally, a colored liquid electrophotographic ink can be located in each of the other BID units. The present LEP printer can be a 1-shot process printer that transfers a complete multi-color image to the substrate at one time. For example, if an image is included of four color separations (e.g., black, cyan, magenta, and yellow), an exemplary mode of operation could involve charging the PIP with the appropriate pattern for the yellow electrophotographic ink. As the PIP rotates, the BID that contains yellow liquid electrophotographic ink can apply the toner onto the coated PIP surface 222, developing the latent image. The yellow electrophotographic ink image can then be transferred to the ITM surface 224 where it remains, awaiting the deposit of the remaining color layers, cyan, magenta and black. This cycle can be repeated for each of the remaining colors until a complete multi-colored image is located on ITM. Once the complete image is assembled, it can be deposited all at once onto the substrate. In another embodiment, the LEP printer can transfer each colored liquid electrophotographic ink to the substrate sequentially.

The liquid electrophotographic inks or liquid toners described herein can be any such ink or toners known in the art, including liquid electrophotographic inks that include a liquid vehicle, a colorant, a charging component, and, optionally, polymer(s). Additionally, other additive may be present in the liquid toner.

Notably, it has been recognized that a thin layer of the coatings described herein can improve the life of conductive substrates without affecting the electrical properties of the photoconductive substrate. As such, the present coatings can extend the life of a photoconductive substrate, including those used in LEP applications.

It is noted that, as used in this specification and the appended claims, the singular forms "a," "an," and "the" include plural referents unless the context clearly dictates otherwise.

As used herein, "liquid electrophotographic ink" or "liquid toner" generally refers to an ink having a liquid vehicle, a colorant, a charging component, and polymer(s) used in electrophotographic printing.

As used herein, "liquid electrophotographic printing" "LEP," or "electrostatic printing" generally refers to the process that provides a liquid electrophotographic ink or ink toner image that is electrostatically transferred from a photo imaging plate to an intermediate drum or roller, and then thermally transferred to a substrate, or to the process wherein the ink image is electrostatically transferred from the photo imaging plate directly onto a substrate. Additionally, "liquid electrophotographic printers" generally refer to those printers capable of performing electrophotographic printing, as described above. These types of printers are different than traditional electrophotographic printers that utilized essentially dry charged particles to image a media substrate.

As used herein, "photoconductive substrate" refers to any substrate for transferring of inks used in the imaging of photoconductive materials including LEP printing. In one embodiment, the photoconductive substrate can be a photo imaging plate of an LEP printer.

As used herein, "charge transport material" refers to compounds, including polymers, that allows for the transport of electrostatic charges through a coating used in electrophotographic printing such as coated photoconductive substrates.

As used herein, "devoid of" refers to the absence of materials in quantities other than trace amounts, such as impurities.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

EXAMPLES

The following examples illustrate embodiments of the disclosure that are presently known. Thus, these examples should not be considered as limitations of the present technology, but are merely in place to teach how to make compositions of the present disclosure. As such, a representative number of compositions and their method of manufacture are disclosed herein.

Example 1—Formulation of Coating #1 for Photoconductive Substrate

Stock solutions of polyvinylphenol (PVP) of weight average molecular weight 11K (2%), bisphenol A glycerolate dimethacrylate (BPG DMA) (5%) and glycerol trioctanoate (1%) in isopropyl alcohol (IPA) were prepared. A solution was made by mixing 2% PVP of weight average molecular weight 11K (1.346 g), 5% BPG DMA (0.2614 g), 2,2'-azobisisobutyronitrile (0.002 g) and 1% glycerol trioctanoate (0.294 g) in IPA (18.0966 g) to have 0.2% of solid material excluding glycerol trioctanoate content. This solution was coated on a photo imaging plate (PIP) using an automatic coater with various speeds and the solvent was allowed to evaporate. Then the PIP was heated to 80° C. for 1 hour to cure the acrylic component. The estimated thickness of the coating was 10 nm.

Example 2—Formulation of Coating #2 for Photoconductive Substrate

Example 1 was repeated with the same quantities except IPA was used in the amount of 8.0966 g. Coating was carried out in the same manner as discussed in Example 1. The thickness of the coating was 20 nm.

Example 3—Formulation of Coating #3 for Photoconductive Substrate

Stock solutions of polyvinylphenol (PVP) of weight average molecular weight 25K (2 wt %), a blocked isocyanate (Duranate™ MF-K60B-60 wt % in butyl alcohol and butyl acetate mixture) was diluted 10 times in IPA to have a concentration of 6% of blocked isocyanate. A solution was made by mixing 2 wt % PVP of weight average molecular weight 25K (1.2 g), diluted isocyanate (0.267 g) and 1 wt % glycerol trioctanoate (0.261 g) in IPA (18.271 g) to have 0.2 wt % of solid material excluding glycerol trioctanoate content. This solution was coated on a photo imaging plate (PIP) using an automatic coater with various speeds and the solvent was allowed to evaporate. Then the PIP was heated to 90° C. for 1 hour to cure the isocyanate moiety. The estimated thickness of the coating was 10 nm.

Example 4—Formulation of Coating #4 for Photoconductive Substrate

Example 3 was repeated with the same quantities except IPA in the amount of 8.533 g and without 1% glycerol trioctanoate solution. Coating was carried out in the same manner as discussed in Example 3. The estimated thickness of the coating was 20.

Example 5—Printing Using Coated Photoconductive Substrates

Figure 3:
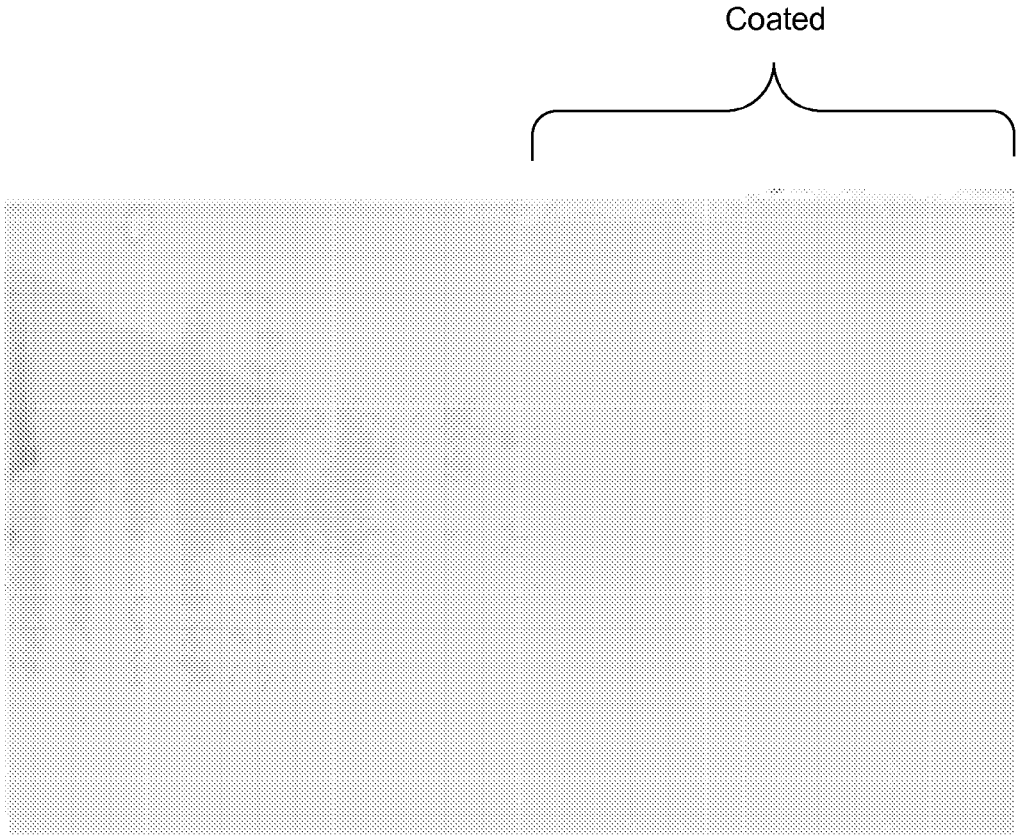
FIG. 3 is a photograph of a recording medium printed from a liquid electrophotographic (LEP) printer at 20% optical density using black liquid toner, the printer having a photoconductive substrate coated on one half and which is also uncoated on the other half (after 30,000 impressions) in accordance with some examples of the present disclosure.

FIG. 3 compares printed pages after 30K impressions using an OPC that was half coated with the protective layer of Example 1. Generally, extended printing causes overall decrease of an optical density (known as old photoconductor syndrome (OPS)) and localized line variation of the optical density (known as streaky OPS). However, at 30K impressions, the printed image from both halves (coated and uncoated) are not visually distinguishable.

Figure 4:
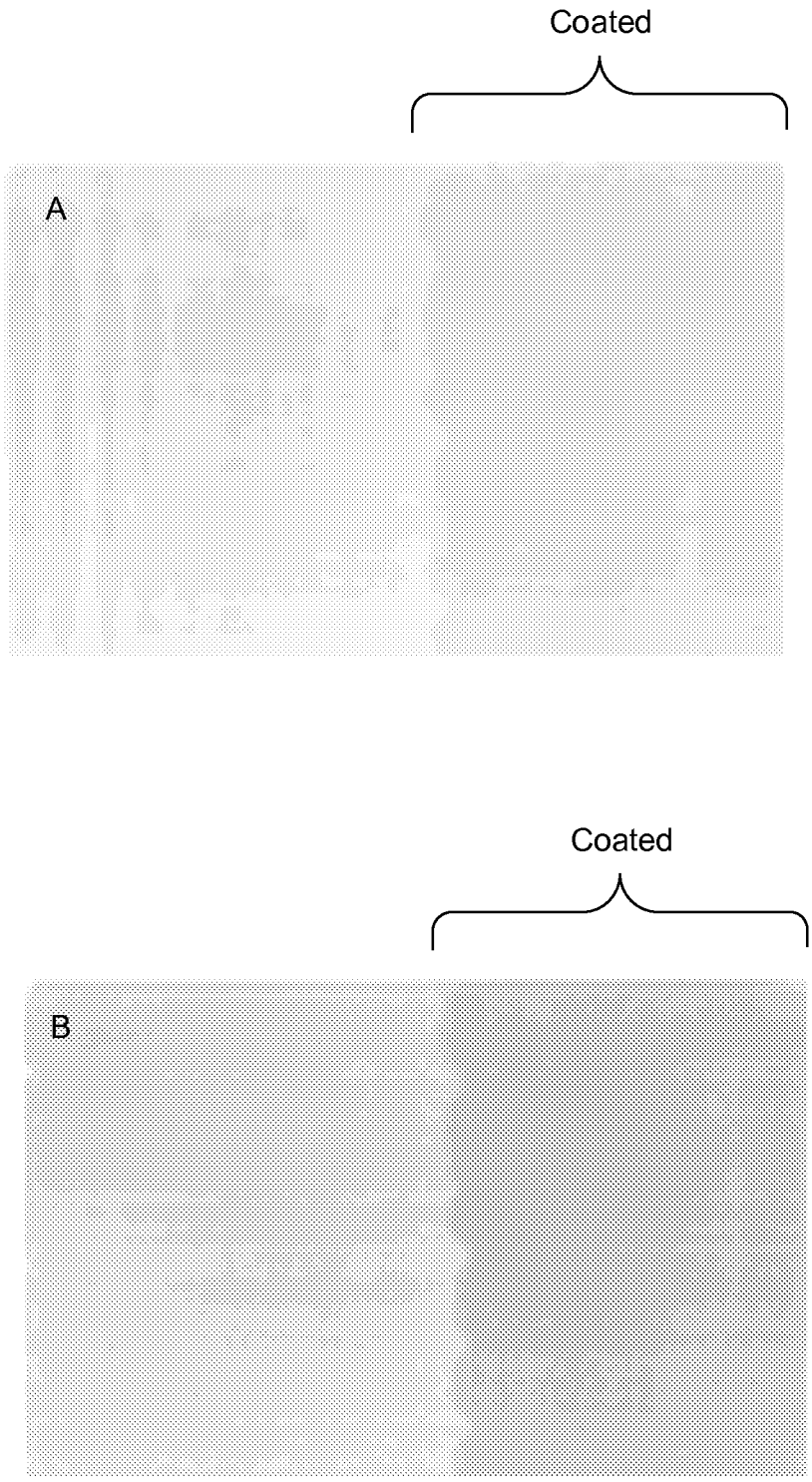
FIGS. 4A-B are photographs of a recording medium printed from a liquid electrophotographic (LEP) printer at 20% optical density using black liquid toner (A) and cyan, magenta, yellow, and black liquid toners (B), the printer having a photoconductive substrate coated on one half and which is also uncoated on the other half (after 160,000 impressions) in accordance with some examples of the present disclosure.

FIGS. 4A-B compares printed pages after 160K impressions using an OPC that was half coated with the protective layer. Specifically, FIGS. 4A-B provide printed images using black ink at 20% optical density (A) and using black, yellow, magenta, and cyan inks at 20% optical density (B) showing OPS and streaky OPS from the uncoated half of the photoconductor. As such, the present coatings protect the photoconductor from both types of OPS.

Figure 5:
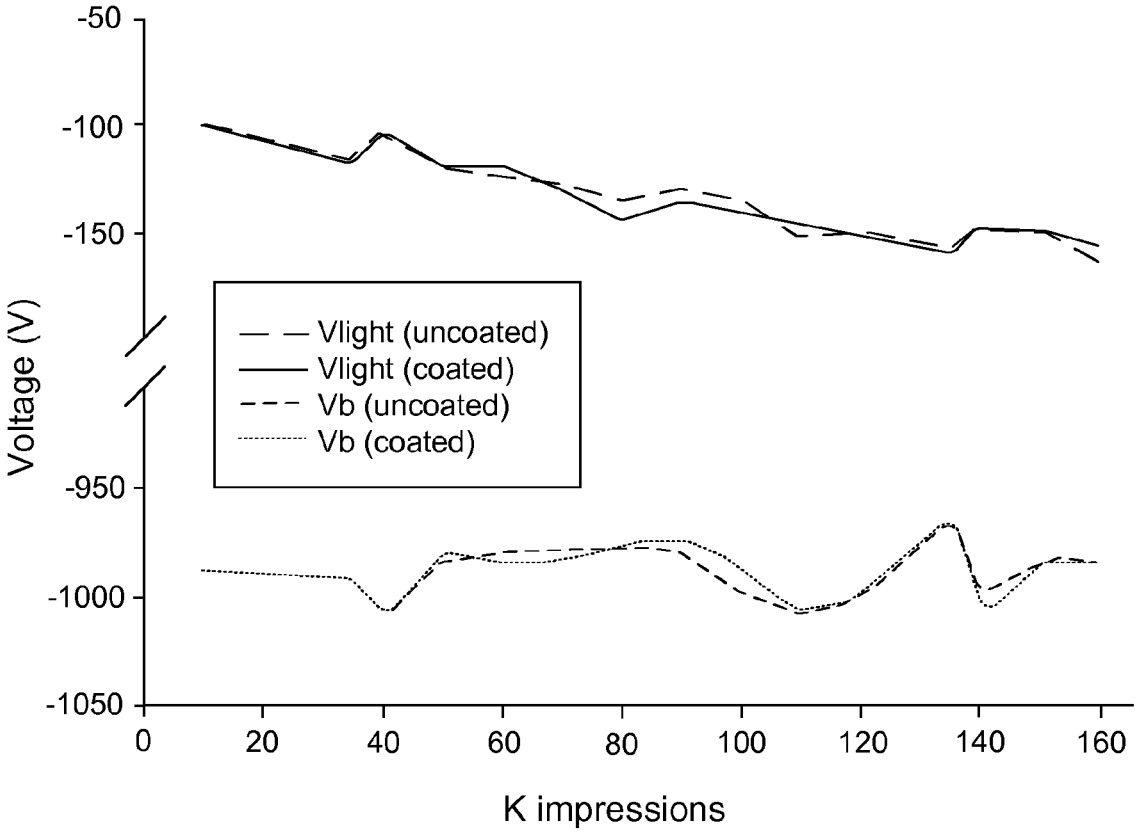
FIG. 5 is a graph of $V_{light}$ and $V_{background}$ vs. impressions for a liquid electrophotographic printer with coated and uncoated photoconductive substrates in accordance with some examples of the present disclosure.

FIG. 5 demonstrates that a thin coating does not affect electrical properties of the photoconductor. The same $V_{light}$ and $V_{background}$ values were observed in coated and uncoated areas during an extended printing.

While Example 2 provided similar performance to Example 1, Examples 3 and 4 did not perform as well, but still providing better results than the uncoated OPC. Without intending to be bound by any particular theory, it is thought that because the amount of thermoplastics PVP present in the Examples 3 and 4 is lower (1.346 g for Examples 1 and 2 compared to 1.2 g for Examples 3 and 4), the performance is also lower.

In summary, the present coatings improve the life of the organic photoconductor (OPC) without affecting the $V_{light}$ for conductivity. The coatings do not affect the underlying photoconductor. In addition, the coating can improve scratch resistance. The number of impressions obtained using the coated OPC's are increased significantly without affecting the print quality. The cost of the materials can be low (<$0.25 per PIP) providing a significant cost savings as compared to traditional coatings using charge transport materials (>$1.00 per PIP).

While the disclosure has been described with reference to certain embodiments, those skilled in the art will appreciate that various modifications, changes, omissions, and substitutions can be made without departing from the spirit of the disclosure. It is intended, therefore, that the disclosure be limited only by the scope of the following claims.

What is claimed is:

1. A coated photoconductive substrate, comprising:

a photoconductive substrate, the photoconductive substrate including a charge generation layer and a charge transport layer; and a coating adhered to the photoconductive substrate, the coating comprising a cross-linkable polymer, the cross-linkable polymer including polymerized monomers selected from acrylates, methacrylates, vinyl monomers, isocyanates, polyols, epoxies, ethers, combinations thereof, or mixtures thereof and having a thickness at from 1 nm to 200 nm.

2. The coated photoconductive substrate of claim 1, wherein the thickness ranges from 20 nm to 80 nm.

3. The coated photoconductive substrate of claim 1, wherein the photoconductive substrate is a photo imaging plate in a liquid electrophotographic printer.

4. The coated photoconductive substrate of claim 1, wherein the cross-linkable polymer comprises a polymerized monomer selected from bisphenol A dimethacrylates, bisphenol A ethoxylate dimethacrylates, bisphenol A glycerolate dimethacrylate, pentaerythritols, pentaerythritol triacrylates, pentaerythritol trimethacryaltes, pentaerythritol tetraacrylates, pentaerythritol tetramethacrylates, bisphenol A diglycidyl ethers, butanediol diglycidyl ethers, bisphenol A ethoxylates, brominated bisphenol A diglycidyl ethers, diisocyanates, tolylenedisiocyanate, isophoronediisocyanate, 1,8-diisocyantooctane, 1,8-octanediol, vinylphenol, vinylbutyral, styrene, hydroxyethyl acrylate, hydroxyethyl methacrylate, vinylpyridine, butylene glycol, combinations thereof, or mixtures thereof.

5. The coated photoconductive substrate of claim 1, wherein the cross-linkable polymer is present in the coating in an amount ranging from 50 wt % to 99.9 wt %.

6. The coated photoconductive substrate of claim 1, wherein the coating further comprises an antioxidant polymer.

7. The coated photoconductive substrate of claim 1, wherein the coating is devoid of charge transport materials including tri-p-tolylamine (PTA), N,N'-bis(3-methylphenyl)-N,N'-diphenylbenzidine (TBD), chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene-4-on, 1,3,7-trinitrodibenzothiophene-5,5-dioxide, diphenoquinones, oxazoles, oxadiazoles, imidazoles, monoarylamines, diarylamines, triarylamines, stilbenes, α-phenyl stilbenes, benzidines, diarylmethanes, triarylmethanes, 9-styrylanthracenes, pyrazolines, divinyl benzenes, hydrazones, indenes, butadienes, pyrenes, bisstylbenes, enamines, and aromatic tertiary amines.

8. The coated photoconductive substrate of claim 1, wherein the coating is coated on the surface of the charge transport layer.

9. The coated photoconductive substrate of claim 1, wherein the coating further comprises thermoplastic polymer, cross-linked polymer, anti-oxidant polymer, or combinations thereof.

10. A method of manufacturing a coated photoconductive substrate, comprising applying a coating to a photoconductive substrate, wherein:

the photoconductive substrate includes a charge generation layer and a charge transport layer, and wherein upon applying, and the coating is adhered to the photoconductive substrate, the coating comprising a cross-linkable polymer, the cross-linkable polymer including polymerized monomers selected from acrylates, methacrylates, vinyl monomers, isocyanates, polyols, epoxies, ethers, combinations thereof, or mixtures thereof, and wherein the coating has a thickness ranging from 1 nm to 200 nm.

11. The method of claim 10, wherein the photoconductive substrate is a photo imaging plate in a liquid electrophotographic printer and wherein the coating provides to the photoconductive substrate a $V_{light}$ of less than 200 volts after 100,000 printed images.

12. A liquid electrophotographic printer, comprising:

a coated photoconductive substrate for forming an electrostatic image, the coated photoconductive substrate, including:

a photoconductive substrate having a charge generation layer and a charge transport layer, and a coating adhered to the photoconductive substrate, the coating comprising a cross-linkable polymer, the cross-linkable polymer including polymerized monomers selected from acrylates, methacrylates, vinyl monomers, isocyanates, polyols, epoxies, ethers, combinations thereof, or mixtures thereof, and having a thickness ranging from 1 nm to 200 nm;

a charging unit configured to charge at least a portion of the coated photoconductive substrate to form a latent image;

a binary image developer for applying electrophotographic ink to the latent image to form a developed image;

an intermediate transfer member that receives the developed image; and an impression roller having a recording medium that receives the developed image from the intermediate transfer member.

13. The liquid electrophotographic printer of claim 12, wherein the coating has a thickness of 20 nm to 80 nm and wherein the coating provides a $V_{light}$ of less than 200 volts after 100,000 printed images.

14. The coated photoconductive substrate of claim 1, wherein the coating comprises a cross-linker selected from polyisocyanates, polyols, polyacids, polyesters, polyamines, or combinations thereof.

15. The coated photoconductive substrate of claim 14, wherein the cross-linker is present in the coating from 0.1 wt % to 50 wt %.

16. The coated photoconductive substrate of claim 6, wherein the antioxidant polymer comprises polyvinylphenols, hindered amines, or combinations thereof.

17. The liquid electrophotographic printer of claim 12, wherein the photoconductive substrate is a photo imaging plate.

18. The liquid electrophotographic printer of claim 12, wherein the coating is devoid of charge transport materials including tri-p-tolylamine (PTA), N,N'-bis(3-methylphenyl)-N,N'-diphenylbenzidine (TBD), chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene-4-on, 1,3,7-trinitrodibenzothiophene-5,5-dioxide, diphenoquinones, oxazoles, oxadiazoles, imidazoles, monoarylamines, diarylamines, triarylamines, stilbenes, α-phenyl stilbenes, benzidines, diarylmethanes, triarylmethanes, 9-styrylanthracenes, pyrazolines, divinyl benzenes, hydrazones, indenes, butadienes, pyrenes, bisstylbenes, enamines, and aromatic tertiary amines.

* * * * *